US005560224A

United States Patent [19]

Tessler

[11] Patent Number: 5,560,224

[45] Date of Patent: Oct. 1, 1996

[54] JEWELRY MOUNTING RELATIVELY LARGE STONES HIGHER THAN RELATIVELY SMALL STONES AND METHOD OF MANUFACTURE

[76] Inventor: Mark Tessler, 28 Crestwood Dr., Maplewood, N.J. 07040

[21] Appl. No.: 361,201

[22] Filed: Dec. 21, 1994

[51] Int. Cl.[6] ..... A44C 17/02

[52] U.S. Cl. ..... 63/28

[58] Field of Search ..... 63/26, 28, 15; D11/89, 91

[56] References Cited

U.S. PATENT DOCUMENTS

| | | | |
|---|---|---|---|
| 330,230 | 11/1885 | Hafner | 63/28 |
| 665,089 | 1/1901 | Greenberg | 63/28 |
| 1,328,948 | 1/1920 | Dover | 63/28 |
| 1,863,617 | 6/1932 | Brogan | 63/26 |
| 2,117,736 | 5/1938 | Link | 63/28 |
| 4,566,294 | 1/1986 | Brzozowski | 63/28 |
| 4,819,453 | 4/1989 | McNamara | 63/28 |
| 5,099,660 | 3/1992 | Dostourian | 63/28 |

*Primary Examiner*—Flemming Saether
*Attorney, Agent, or Firm*—R. Gale Rhodes, Jr.

[57] ABSTRACT

Jewelry embodying the present invention and satisfying the foregoing needs includes a body of jewelry material, a plurality of relatively large gems and a plurality of relatively small gems, and a gem mounting on the body of jewelry material mounting the gem serially, non-overlapped and alternating individual relatively large and relatively small gems and mounting the relatively large gems at a higher level than the relatively small gems. A method embodying the present invention and satisfying the foregoing needs in the art includes the steps of providing a body of jewelry material, providing a first plurality of relatively large gems and a second plurality of relatively small gems, mounting the gems on the body of jewelry material serially, non-overlapping and alternating relatively large and relatively small gems and mounting the first plurality of relatively large gems at a higher level than the second plurality of relatively small gems.

13 Claims, 3 Drawing Sheets

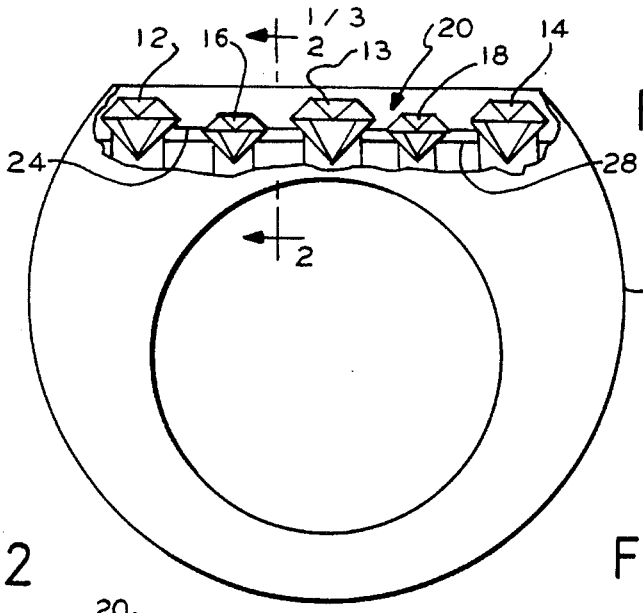
FIG. 1
FIG. 2
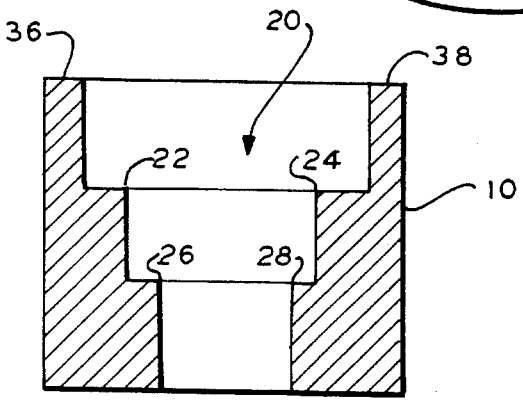
FIG. 3
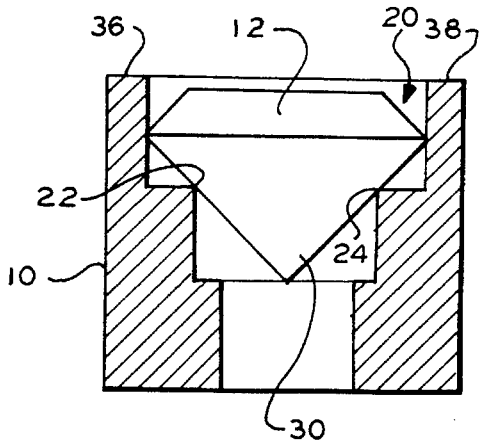
FIG. 4
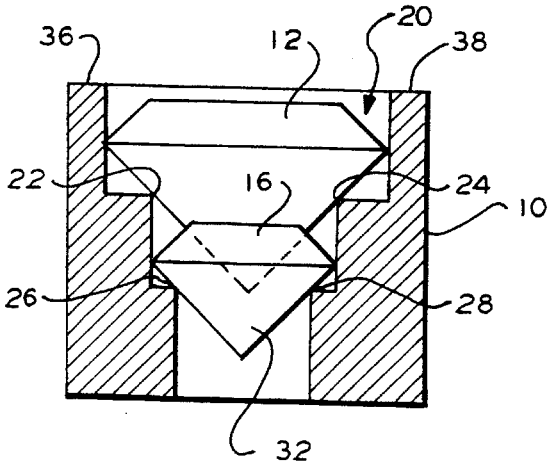
FIG. 5
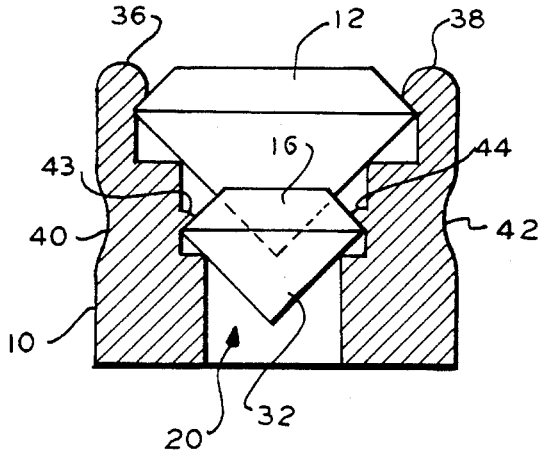

JEWELRY MOUNTING RELATIVELY LARGE STONES HIGHER THAN RELATIVELY SMALL STONES AND METHOD OF MANUFACTURE

BACKGROUND OF THE INVENTION

This invention relates generally to new and improved jewelry and method of jewelry manufacturing, and more particularly relates to new and improved jewelry wherein a plurality of relatively large stones are mounted higher than a plurality of relatively small stones to enhance their brilliance and a method of manufacturing such jewelry.

As known to those skilled in the jewelry art, jewelry may be manufactured in the form of rings, bracelets, pendants, necklaces, pins, watch band links, settings, galleries, ornaments, findings, castings, or the like, and may include, for example, diamonds, rubies, emeralds, sapphires and other precious, semi-precious or artificial gems or gem stones.

As is further known to the jewelry art, jewelry is made from many different bodies of jewelry material, such as gold, silver, platinum, and the like and alloys thereof.

As is still further known to those skilled in the jewelry art, natural gems, as their name indicates, occur in nature, and, even after cutting and polishing, typically come in varying sizes and shapes. For example, with respect to diamonds, even though all diamonds in a group from a suitable source may come polished and cut into the well known round brilliant shape, squares, baguettes, and other known shapes, such diamonds typically come in a melange of different sizes and different carats or weights. Prior to setting in jewelry, diamonds from a typical melange are typically graded to provide groups or pluralities of diamonds of the same general size and carat or weight, and even though such diamonds may be graded into two groups or pluralities of relatively large and relatively small diamonds (and typically with at least a few remaining culls), there still exists a need in the art for a jewelry mounting or setting for such gems which permits the jeweler to use a mix of such relatively large and small gems which enhances their overall brilliance and therefore their visual attractiveness and saleability.

Further known to those skilled in the jewelry art is that a single one carat diamond is considerably more expensive than the total price of two smaller half carat diamonds. Accordingly, by way of example and not by way of limitation, there exists a need in the art for a jewelry mounting and a method of mounting pluralities of relatively small and relatively large diamonds in a manner that their overall brilliance and visual attractiveness at least approximates the brilliance and attractiveness of a single, larger diamond whose weight is the same, or at least substantially the same, as the total or accumulative weight of the pluralities of relatively small and relatively large diamonds.

As is yet further known to those skilled in the jewelry art, current regulations strictly prescribe the advertising of gems, such as diamonds, by their carat or weight and require that the gems sold under such advertisement adhere strictly to the advertised carat or weight. Accordingly, there exists a further need in the jewelry art for a new and improved gem mounting and method of gem mounting which permits the jeweler to mount pluralities of relatively large and relatively small gems in a manner such that their total or cumulative carat or weight more nearly totals an advertised carat or weight and which only minimally is below or minimally above the advertised carat or weight. For example, if a jeweler has five diamonds, three of which are relatively large each of 0.11 carat, and two of which are relatively small each of 0.085 carat, the three relatively large diamonds have a combined weight of 0.33 carat and the two relatively small diamonds have a combined weight of 0.17 carat, and such total diamonds have a total or cumulative weight of 0.5 carat. It is well known that such five diamonds having a cumulative weight of 0.5 carat are less expensive than a single 0.5 carat diamond. Accordingly, there is a need for the jeweler to mount such five diamonds in a manner that they approximate the brilliance and visual attractiveness of a single 0.5 carat diamond and which permits the jeweler to add or subtract a relatively large or a relatively small gem from a setting and more nearly meet the advertised carat without losing money or risking a charge of false advertising.

Numerous gems or gem stones mountings or settings are known to the art as are numerous prior inventions for setting such gems or gem stones. U.S. Pat. No. 4,566,294 entitled METHOD FOR THE MOUNTING OF GEMS AND RESULTING PRODUCT, patented Jan. 28, 1986, discloses a mounting and method utilizing a groove having an inwardly tapered conical lower portion wherein the taper of the groove is smaller than the taper of the pavilions of the stones set in the groove. This is contrary to certain embodiments of the present invention comprising an inwardly tapered groove, conical in transverse cross-section, or conical cavities wherein the taper of the groove or cavities is substantially the same as the taper of the pavilions of the stones set in the groove or cavities. Another patent disclosing a mounting for gems is U.S. Pat. No. 5,099,660 entitled MOUNTING FOR GEM STONES, patented Mar. 31, 1992. This patent discloses a setting wherein alternating relatively large and relatively small stones are set with the relatively large stones being set higher than the relatively small stones. The stones alternate one relatively large stone and two relatively small stones with portions of the relatively small stones being overlapped by the adjacent relatively large stones. This overlapping of stones, unlike the present invention, undesirably causes a loss in viewing of portions of the relatively small stones and a loss in brilliance from the overlapped smaller stones.

Still further, there exists a need in the art for a jeweler to be able to satisfy the foregoing needs and to do so with a jewelry mounting or setting, and method of manufacture, which permits such needs to be satisfied utilizing machine setting of the gems with a minimum of hand or manual setting.

SUMMARY OF THE INVENTION

It is the object of the invention to satisfy the foregoing needs in the jewelry art.

Jewelry embodying the present invention and satisfying the foregoing needs includes a body of jewelry material, a plurality of relatively large gems and a plurality of relatively small gems, and a gem mounting on the body of jewelry material mounting the gem serially, non-overlapped and alternating individual relatively large and relatively small gems and mounting the relatively large gems at a higher level than the relatively small gems.

A method embodying the present invention and satisfying the foregoing needs in the art includes the steps of providing a body of jewelry material, providing a first plurality of relatively large gems and a second plurality of relatively small gems, mounting the gems on the body of jewelry material serially, non-overlapping and alternating relatively large and relatively small gems and mounting the plurality of relatively large gems at a higher level than the plurality of relatively small gems.

DESCRIPTION OF THE FIGURES

FIG. 1 is a side view, with a portion broken away, of a ring embodying the present invention;

FIG. 2 is a transverse cross-sectional view of a gem receiving groove taken generally along the line 2—2 in FIG. 1 in the direction of the arrows;

FIG. 3 is a view similar to FIG. 1 but illustrating the relatively higher setting of a relatively large gem;

FIG. 4 is a view similar to FIGS. 2 and 3 but illustrating the setting of a relatively large stone higher and the setting of a relatively small stone;

FIG. 5 is a view similar to FIG. 4 but illustrating the deforming of portions of the jewelry material to mount and retain the gems in the body of jewelry material;

DESCRIPTION OF THE PREFERRED EMBODIMENTS

Figure 6:
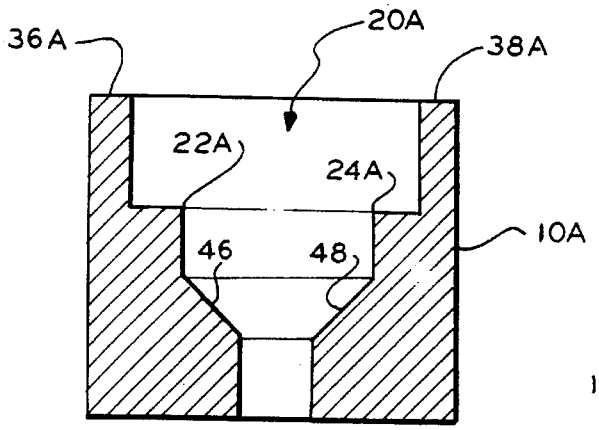
FIG. 6 illustrates a second embodiment of the present invention and is a view similar to FIG. 2.

Referring now to FIGS. 1–5, a first embodiment of jewelry and jewelry manufacturing method of the present invention is illustrated. In this embodiment the jewelry is embodied as a ring 10, of suitable jewelry material of the type noted above, and includes a first plurality of relatively large gems 12, 13 and 14 and a second plurality of relatively small gems 16 and 18. The gems, in this embodiment, are diamonds of the round brilliant shape including the well-known crown, girdle and pavilion. The top portion of the ring is provided with a longitudinally extending groove indicated by general numerical designation 20 and which groove may be formed by any one of several well known groove forming manufacturing steps known to the jewelry art. From FIG. 2, it will be understood that the groove 20 extends downwardly or inwardly of the ring 10 in a generally stair stepped manner. The groove 20 provides a first pair of spaced apart and opposed pavilion engaging edges 22 and 24 and a second pair of spaced apart and opposed pavilion engaging edges 26 and 28 with the pairs 26 and 28 residing below and inwardly of the groove 20 with respect to the pair of edges 22 and 24.

As will be understood from FIG. 3 and with regard to exemplary or representative relatively large gem 12, the opposed pair of pavilion engaging edges 22 and 24 is for engaging and supporting the pavilions of the relatively large stones such as, for example, the pavilion 30 of the relatively large stone 12. As will be understood from FIG. 4 with regard to the exemplary or representative relatively small stone 16, the pair of edges 26 and 28 are for engaging and supporting the pavilions of the relatively small stones such as for example the pavilion 32 of the relatively small stone 16. Significantly, it will be understood from FIG. 4 that the pair of edges 22 and 24 engage and support the pavilions of the relatively large stones at a higher level than the pair of edges 26 and 28 engage and support the pavilions of the relatively small stones.

Referring again to FIG. 2, forming of the groove 20 provides a pair of rims 36 and 38 upstanding above the pairs of edges 22 and 24 and 26 and 28, and as will be further understood from FIG. 5, these upstanding rims are suitably deformed inwardly to mount and retain the relatively large gems in the groove 20. Similarly, portions of the rings 40 and 42 are deformed inwardly to deform portions of the rings 43 and 44 to mount and retain the relatively small gems in the groove 20. The ridges 36 and 38 may be deformed by a suitable roller as known to the art, and as taught in U.S. Pat. No. 4,566,294 noted above. Similarly, suitable side engaging rollers may be used to engage the sides of the ring 10 to deform the portions 40 and 42 and 43 and 44 as described.

Figure 7:
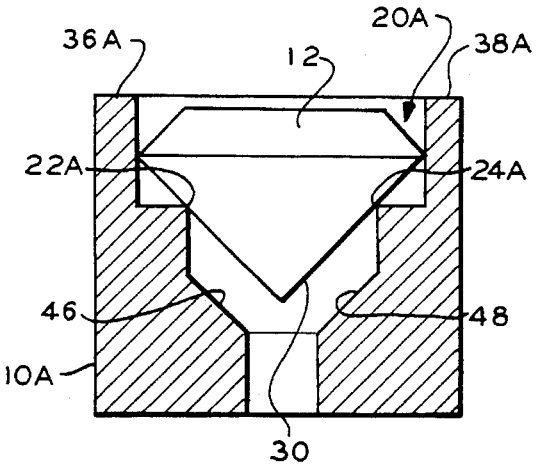
FIG. 7 is a further illustration of the second embodiment of the present invention and this view is similar to FIG. 3.
Figure 8:
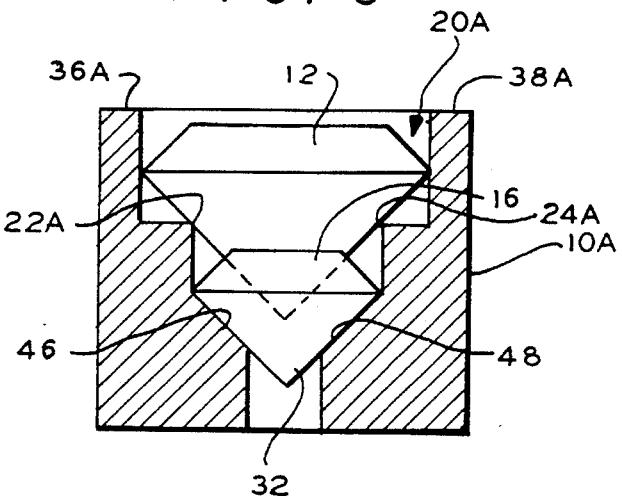
FIG. 8 is a view similar to FIG. 4 with regard to the second embodiment of the present invention.

FIGS. 6–8 illustrate a second embodiment of the present invention wherein the longitudinally extending groove 12A extends downwardly and is generally stair stepped, however in this embodiment the groove 20A provides an upper pair of spaced apart and opposed pavilion engaging edges 22A and 24A and a pair of spaced apart and opposed inwardly tapering surfaces 46 and 48. Referring to FIG. 7, as in the first embodiment, the opposed edges 22A and 24A are for engaging and supporting the pavilions of the relatively large gems such as the pavilion 30 of the exemplary or representative relatively large stone 12. As will be understood by referring to FIG. 8, the inwardly tapering surfaces 46 and 48 are for engaging and supporting the pavilions of the relatively small stones, such as for example the pavilion 32 of the exemplary or representative relatively small stone 16. It will be further understood that the relatively large and small stones are mounted and retained in the groove 20A in the same manner as illustrated in FIG. 5 with regard to the first embodiment of the present invention.

Figure 9:
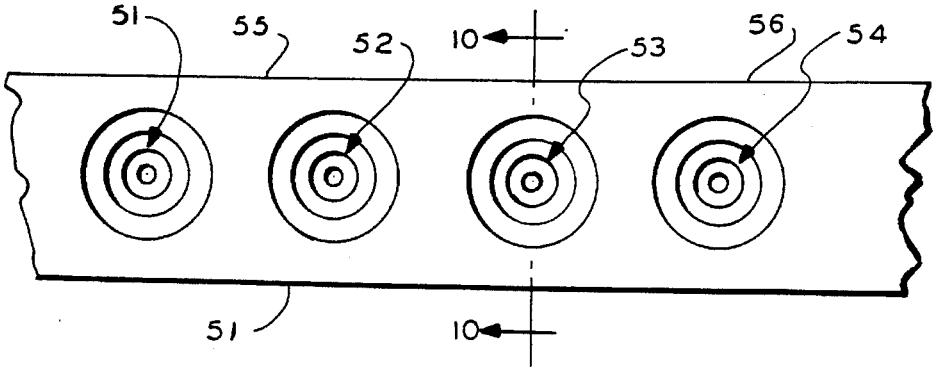
FIG. 9 is a partial top or plan view of a third embodiment of the present invention and may be, for example, a partial top view of a ring embodying a third embodiment of the present invention.
Figure 10:
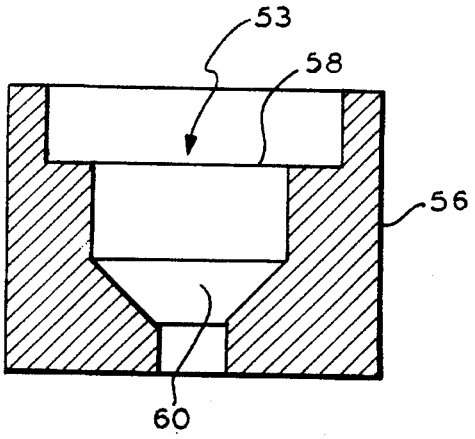
FIG. 10 is a transverse cross-sectional view taken generally along the line 10—10 in FIG. 9 in the direction of the arrows.

Referring now to the third jewelry and jewelry manufacturing method of the present invention illustrated in FIGS. 9 and 10, this embodiment includes, for example, a ring 56 provided with a plurality of generally linearly aligned and generally cylindrical counter sunk cavities or holes 51–54. These cavities or holes may be formed by any one of several countersunk cavity forming means known to the jewelry art. As will be understood from FIG. 10 and representative cavity 53, cavity 53 is generally stair stepped and provides a circular edge 58 and an inwardly tapering frusto-conical surface 60 residing below and inwardly of the circular edge 58 with respect to the cavity 53. It will be understood that alternate ones of the circular edges 58 of the cavities 51–54 are for engaging and supporting the pavilions of the relatively large stones such as for example the pavilion 30 of relatively large stone 12 shown in FIG. 3, and that other alternate ones of the inwardly tapering surfaces 60 of the cavities 51–54 are for engaging and supporting the pavilions of the relatively small stones, such as for example the pavilion 32 of relatively small stone 24 shown in FIG. 4. Accordingly, it will be understood that the plurality of cavities 51–54 of FIG. 9 support a first plurality of relatively large stones and a second plurality of relatively small stones with the smaller stones being mounted at a lower level with respect to the higher stones and with the stones being disposed linearly serially, non-overlapping and alternating individual relatively large and relatively small stones. The stones are initially held in place in the cavities 51–54 by a light force fit, or by the use of a suitable detergent, and are permanently secured in place, or mounted, by inward rolling of the upper ring portions 55 and 57 as taught above with regard to ring 36 and 38 and as shown in FIG. 3.

Figure 11:
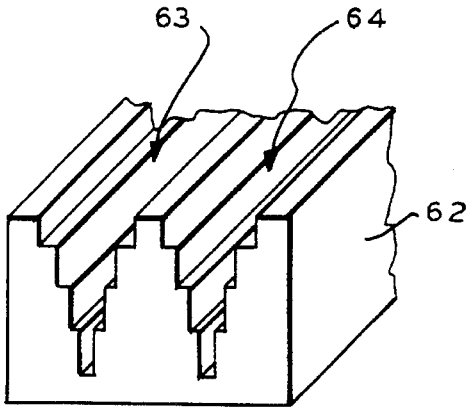
FIG. 11 is a diagrammatical illustration of a still further embodiment of the present invention.

A further alternate embodiment of the jewelry manufacturing method of the present invention is illustrated diagrammatically in FIG. 11, and it will be understood that in this invention, a jewelry body, such as for example a portion of a ring or bracelet 62, is provided with a pair of generally parallel grooves 63 and 64 each providing three pairs of spaced apart and opposed pavilion engaging edges with each successively inward pair of opposed edges residing lower and inwardly with respect to the preceding upper pair of opposed pavilion engaging edges. The three pairs of pavilion engaging edges are for engaging and supporting the pavilions of three groups or pluralities of stones with the largest stone being set the highest, the next largest stone being set in the middle, and the smallest stone being set at the lower level.

Figure 12:
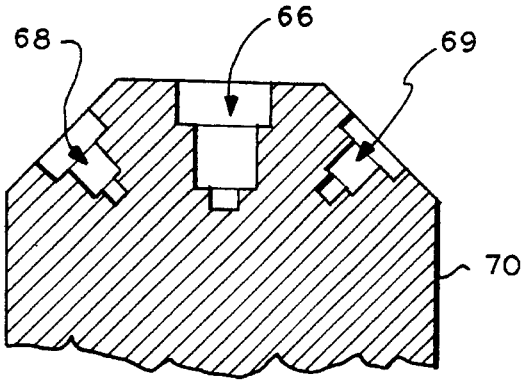
FIG. 12 is a partial transverse cross-sectional view of a still further embodiment of the present invention.

It will be further understood that in further embodiments of the jewelry manufacturing method of the present invention, FIG. 12, instead of two parallel rows of grooves as illustrated diagrammatically in FIG. 11, three grooves 66, 68 and 69 may be provided with the central groove 66 residing generally in the plane of, for example, a ring 70 and with the two side grooves 68 and 69 oriented angularly with respect to the middle groove 66. It will be understood that the grooves 66, 68 and 69 may be inwardly generally stair stepped in the shape of the groove 20 shown in FIG. 2, the shape of the groove 20A shown in FIG. 6, or alternatively may comprise rows of a plurality of countersunk cavities or holes 51–54 as shown in FIGS. 9 and 10.

Figure 13:
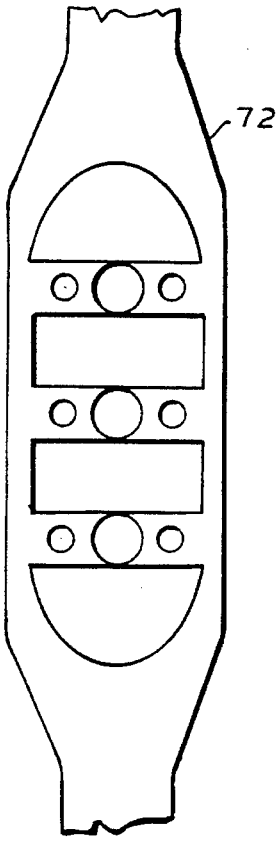
FIG. 13 is a partial top view of a still further embodiment of the present invention.
Figure 14:
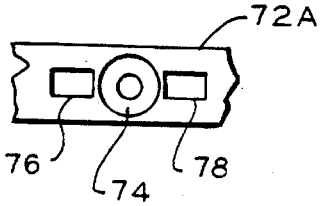
FIG. 14 is a partial top view of a still further embodiment of the present invention.

Referring to FIG. 13, it will be understood that in accordance with the present invention a row of alternating relatively large and relatively small gems may be mounted in a body of jewelry material, such as the ring 72 shown partially in FIG. 13, and may be oriented generally transverse to the plane of the ring as illustrated diagrammatically in FIG. 13. Further alternatively, as illustrated in FIG. 13, it will be understood that instead of a row or rows of diamonds mounted serially, non-overlapped and alternating individual relatively large and relatively small diamonds, other gem arrangements are possible with the present invention. For example, alternating diamonds and sapphires or rubies as illustrated diagrammatically in FIG. 14 with regard to the round brilliant cut diamond 74 and the emerald cut sapphires or rubies 76 and 78. It will be understood that the mounting for the diamond 74 and rubies or sapphires 76 and 78 may be the groove 20 shown in FIG. 2, the groove 20A shown in FIG. 6, or a plurality of countersunk cavities or holes 51–54 as illustrated in FIG. 9; the diamond 74 is mounted higher than the sapphires or rubies.

It will be further understood that upon the gems being received and engaged as disclosed above, for example, in FIGS. 4, 8, or as described with regard to the embodiments of FIGS. 9 and 10, the grooves or countersunk cavities may be filled with a suitable soap to temporarily retain the gems in the grooves or cavities until portions of the jewelry, such as a ring, are deformed inwardly to mount and retain the gems in the grooves and cavities.

It will be understood by those skilled in the jewelry art that the invention embodiments of the present invention provide the following improvements and advances in the jewelry art:

1. A novel way of setting stones into a groove or channel ring, or other jewelry, with at least two levels of settings.
2. A method of setting stones into a groove or channel ring, or other jewelry, whereby the pavilion of a diamond comes into close abutment to the wall of the setting eliminating the space by making the setting the same angle as the pavilion of the stone.
3. The use of soap to temporarily hold the stones or gems instead of wax.
4. Permits the use of melange lots of diamonds whereby irregular shapes and lengths of pavilions at lower cost per carat can be used.
5. Permits the use of melange lots of diamonds whereby irregular tables and girdles at lower cost per carat can be used.
6. Eliminates the necessity of purchasing at higher cost select sizes of diamonds.
7. Setting diamonds at different levels enhances the element of brilliance whereby there is greater reflection and refraction of light in the stones.
8. Setting diamonds at different levels creates styling different from other groove set rings, or other jewelry.
9. A ring, or other jewelry, can be set faster, and mostly by a machine, than in traditional channels requiring manual setting.
10. The additional dimension attained by two levels helps in the designing of channel or groove rings bearing diamonds and quadrillions as well as diamonds and colored stones. The effect is innovative and original.
12. Melange lots of diamonds are more available than select stones and less expensive and their use is enhanced.
13. The two level of stones, with round stones on the top level of a size larger than those set in the lower level, with the lower level set with quadrillions creates an original design at a cost much lower than these presently in the market.
14. One mounting can be used for different sizes of stones, saving customer gold inventory, as opposed to having to stock two rings, one for each size of stone.

It will be understood by those skilled in the art that many variations and modifications may be made in the present invention without departing from the spirit and the scope thereof.

What is claimed is:

1. Jewelry, comprising:

a body of jewelry material;

a plurality of relatively large gems and a plurality of relatively small gems; and said body of jewelry material provided with means mounting said gems serially, non-overlapped and alternating individually relatively large and individually relatively small gems and mounting said relatively large gems at a higher level with respect to said body of jewelry material than said relatively small gems.

2. Jewelry, comprising:

a body of jewelry material;

a first plurality of relatively large gems and a second plurality of relatively small gems;

said body of jewelry material provided with means receiving and disposing said gems serially, non-overlapping and alternating individually relatively large and individually relatively small gems and mounting said first plurality of relatively large gems at a higher level with respect to said body of jewelry material than said second plurality of relatively small gems.

3. Jewelry, comprising:

a body of jewelry material;

at least first and second pluralities of gems, said first plurality of gems relatively larger than said second plurality of gems, each gem having a pavilion;

said body of jewelry material provided with a groove providing at least first and second spaced apart and opposed pairs of pavilion engaging edges, said first pair of edges for receiving and supporting the pavilions of said first plurality of gems and said second pair of edges for receiving and supporting the pavilions of said second plurality of gems, said second pair of edges residing below said first pair of edges with respect to said body of jewelry material and said second pair of edges extending inwardly into said groove with respect to said first pair of edges;

portions of said body of jewelry material deformed inwardly toward said gems to mount and retain said gems in said body of jewelry material; and said gems mounted on said body of jewelry material serially, non-overlapped and alternating individually relatively large and individually relatively small gems.

4. The jewelry according to claim 3 wherein said groove further provides a pair of rims upstanding above said pairs of edges and wherein said rims comprise at least a portion of said jewelry body deformed inwardly.

5. Jewelry, comprising:

a body of jewelry material;

at least first and second pluralities of gems, said first plurality of gems relatively larger than said second plurality of gems, each gem having a pavilion;

said body of jewelry material provided with a plurality of generally linearly aligned and generally cylindrical countersunk cavities each cavity providing a first circular edge and a surface tapering inwardly with respect to said body of jewelry material and having an angle substantially equal to the angle of the pavilion of said relatively small gems, said surface residing below and inwardly of said cavity with respect to said circular edge;

alternate ones of said circular edges edge for receiving and supporting the pavilions of said first plurality of gems and alternate ones of said inwardly tapering surfaces for receiving and supporting the pavilions of said second plurality of gems; and portions of said body of jewelry material deformed inwardly toward said gems to retain said gems in said cavities.

6. Jewelry, comprising:

a body of jewelry material;

at least first and second pluralities of gems, the gems of said first plurality of gems relatively larger than the gems of said second plurality of gems, each gem having a pavilion;

said body of jewelry material provided with downwardly extending generally stair stepped means providing at least first and second pavilion engaging means, said first pavilion engaging means for receiving and supporting the pavilions of said first plurality of gems and said second pavilion engaging means for receiving and supporting the pavilions of said second plurality of gems, said second pavilion engaging means residing below said first pavilion engaging means in said stair stepped means and extending relatively inwardly into said stair stepped means with respect to said first pavilion engaging means;

portions of said body of jewelry material deformed inwardly to mount and retain said gems in said body of jewelry material; and said gems mounted on said body of jewelry material linearly, non-overlapping, and alternating individually relatively large and individually relatively small gems.

7. The jewelry according to claim 6 wherein said generally stair stepped means comprise a groove providing at least first and second spaced apart and opposed pairs of pavilion engaging edges, said first pair of pavilion engaging edges for receiving and supporting the pavilions of said first plurality of gems, and said second pair of pavilion engaging edges for receiving and supporting the pavilions of said second plurality of gems, said second pair of opposed pavilion engaging edges residing below said first pair of pavilion engaging edges in said groove and extending relatively inwardly into said groove with respect to said first pair of pavilion engaging edges.

8. The jewelry according to claim 6 wherein said generally stair stepped means comprise a groove providing a spaced apart and opposed pair of pavilion engaging edges for receiving and supporting the pavilions of said first plurality of gems, and a pair of opposed surfaces tapering inwardly with respect to said body of jewelry material and for receiving and supporting the pavilions of said second plurality of gems, said pair of opposed surfaces residing below said pair of pavilion engaging edges in said groove and extending relatively inwardly into said groove with respect to said pair of pavilion engaging edges.

9. The jewelry according to claim 6 wherein said generally stair stepped means comprise a plurality of generally cylindrical counter sunk cavities each providing at least a first generally circular pavilion engaging edge and a conical pavilion engaging surface tapering inwardly with respect to said body of jewelry material and having an angle substantially equal to the angle of the pavilion of said relatively small gems, said pavilion engaging surfaces residing below said edges with respect to said body of jewelry material and extending inwardly into said body of jewelry material with respect to said edges, wherein said edges are for receiving and supporting the pavilions of said first plurality of gems and wherein said surfaces are for receiving and supporting the pavilions of said second plurality of gems.

10. Method of making jewelry, comprising:

providing a body of jewelry material;

providing a first plurality of relatively large gems and a second plurality of relatively small gems; and subsequently mounting said gems on said body of jewelry material serially, non-overlapping and alternating individually relatively large and individually relatively small gems and mounting said first plurality of large gems at a higher level with respect to said body of jewelry material than said second plurality of relatively small gems.

11. Method of making jewelry, comprising:

providing a body of jewelry material;

providing at least first and second pluralities of gems, the gems of said first plurality relatively larger than the gems of said second plurality, each gem having a pavilion;

providing said body of jewelry material with stair stepped means extending generally downwardly into said body of jewelry material, said stair stepped means providing at least first and second pavilion engaging means with said second pavilion engaging means residing below said first pavilion engaging means and extending inwardly with respect to said first pavilion engaging means; and subsequently mounting said first plurality of gems on said first pavilion engaging means, mounting said second plurality of gems on said second pavilion engaging means and mounting said gems on said body of jewelry material serially, non-overlapping, and alternating individually relatively large and individually relatively small gems.

12. The method of making jewelry according to claim 11 wherein said step of providing said body of jewelry material with said stair step means is the step of forming a groove extending into said body of jewelry material to provide at least first and second spaced apart and opposed pairs of pavilion engaging edges, wherein said first pair of edges is for receiving and supporting the pavilions of said first plurality of gems and wherein said second pair of edges resides in said groove below said first pair of edges with respect to said body of jewelry material and is for receiving and supporting the pavilions of said second plurality of gems.

13. The method of making jewelry according to claim 11 wherein said step of providing said body of jewelry material with said stair step means is the step of forming a plurality of generally cylindrical counter sunk cavities extending into said body of jewelry material, each cavity providing at least a first generally circular pavilion engaging edge and conical pavilion engaging surface extending inwardly into said body of jewelry material and residing below said edge in said cavity, said surface having an angle substantially equal to the angle of the pavilion of said relatively small gems, wherein said edges are for receiving and supporting the pavilions of said first plurality of gems and wherein said surfaces are for receiving and supporting the pavilions of said second plurality of gems.

* * * * *